US006510786B1

(12) United States Patent
Harsch

(10) Patent No.: US 6,510,786 B1
(45) Date of Patent: Jan. 28, 2003

(54) HYDROMECHANICAL PRESS DRIVE

(75) Inventor: Erich Harsch, Weingarten (DE)

(73) Assignee: Mueller Weingarten AG, Weingarten (DE)

( * ) Notice: Subject to any disclaimer, the term of this patent is extended or adjusted under 35 U.S.C. 154(b) by 0 days.

(21) Appl. No.: 09/553,018

(22) Filed: Apr. 20, 2000

(30) Foreign Application Priority Data

Apr. 26, 1999 (DE) ..... 199 18 700

(51) Int. Cl.[7] ..... B30B 1/10

(52) U.S. Cl. ..... 100/286; 100/272; 100/283; 100/346

(58) Field of Search ..... 100/269.01, 258 R, 100/258 A, 270, 271, 272, 273, 280, 281, 286, 346, 283, 284

(56) References Cited

U.S. PATENT DOCUMENTS

| | | | | | |
|---|---|---|---|---|---|
| 739,838 | A | * | 9/1903 | Crow | 100/272 |
| 1,056,788 | A | * | 3/1913 | Harris | 100/286 |
| 2,087,811 | A | * | 7/1937 | Patrick | 100/272 |
| 2,105,053 | A | * | 1/1938 | Patrick | 100/272 |
| 2,738,748 | A | * | 3/1956 | Hecht | 100/286 |
| 3,623,389 | A | | 11/1971 | Krynytzky et al. | 83/617 |
| 4,677,908 | A | * | 7/1987 | Imanishi | 100/257 |
| 4,920,782 | A | * | 5/1990 | Hellwig | 100/272 |
| 4,944,221 | A | * | 7/1990 | Leinhaas | 100/272 |
| 5,746,123 | A | * | 5/1998 | Eigenmann | 100/257 |

FOREIGN PATENT DOCUMENTS

| | | |
|---|---|---|
| DE | 3643502 | 7/1988 |
| DE | 41 18 569 | 12/1992 |
| DE | 19649063 | 5/1998 |
| EP | 0 616 882 | 9/1994 |
| FR | 1575618 | 7/1969 |
| WO | WO 88/05724 | 8/1988 |

OTHER PUBLICATIONS

Manfred Stilz, Industrieanzeiger 16/97, "Eine Stückkosten–Analyse erleichtert die Wahl.", pp. 30 and 31.

* cited by examiner

*Primary Examiner*—John Sipos
*Assistant Examiner*—Louis Huynh
(74) *Attorney, Agent, or Firm*—Morgan, Lewis & Bockius LLP

(57) ABSTRACT

The invention relates to a hydromechanical drive system for at least one press ram of a cutting and/or forming press, at least one drive cylinder being connected to a following kinematic chain. This kinematic chain is designed in such a way that a complete ram stroke, i.e. a downward motion and an upward motion, is effected during a single piston stroke in only one direction. In addition, the proposed drive system has mechanical controlled synchronization.

11 Claims, 6 Drawing Sheets

HYDROMECHANICAL PRESS DRIVE

FIELD OF THE INVENTION

The invention relates to a drive for presses, in particular cutting and/or forming presses, having pressurized drive cylinders which drive a press ram in interaction with articulated elements. If two or more pressure points are used for initiating displacement or force at the ram, the articulated elements are synchronized in a controlled manner. A plurality of rams may also be driven by the use further of [sic] coupling articulations.

BACKGROUND OF THE INVENTION

Continuous-path-control and adaptive-control presses differ, inter alia, according to the type of press drive. Mechanically driven presses work with continuous-path control, i.e. not until the kinematic drive means, e.g. an eccentric, approaches bottom dead center does the desired forming or rated force greatly increase. In contrast, in the adaptive-control, hydraulically driven press, the maximum forming force is available in every ram position. Set against this advantage of the hydraulically driven press are a number of considerable disadvantages, such as, for example, low number of strokes and high drive power to be installed with poor overall efficiency.

A detailed account of the advantages and disadvantages of a hydraulic press compared with a mechanical press may be gathered from the article "Eine Stückkosten-Analyse erleichtert die Wahl" [A unit cost analysis facilitates choice], published in Industrieanzeiger 16/97, pages 30 and 31.

A disadvantage of the mechanically driven press is the complicated and expensive drive, consisting of, for example, motor, clutch/brake combination, flywheel with drive, gear chain with gears, eccentric wheels, connecting rod, shafts and bearings. The attempt to combine the advantages of a hydraulically driven press with those of a mechanical press can be seen from EP 0 616 882. The object of the latter was to achieve an essentially constant forming speed during the entire forming operation. The contents of this publication are essentially the hydraulic activation of the working cylinder and the open-loop and closed-loop control blocks required for this; the actual drive kinematics are not a subject matter of the patent rights. The kinematics shown in diagrammatic sketches correspond to the known toggle-lever or toggle-joint drive known from die-casting or injection-molding machines. This toggle-joint drive, in particular when approaching the extended position of the articulations, requires very large displacements of the drive cylinder with correspondingly large oil quantities.

SUMMARY OF THE INVENTION

The object of the invention is to propose a drive system for a press, which drive system, with a low drive power, achieves a higher number of strokes than a hydraulically driven press and is more cost effective than a mechanical press due to a reduction in the drive elements without dispensing with the controlled synchronization, present in mechanical presses, of the force- or displacement-initiating components.

The accompanying drawings, which are incorporated herein and constitute part of this specification, illustrate presently preferred embodiments of the invention and, together with the general description given above and the detailed description given below, serve to explain features of the invention.

The invention is based on the idea of designing the drive system in such a way that the complete ram stroke, i.e. downward and upward stroke, can be performed with a single cylinder stroke in one direction without reversing connection. In this case, any desired ram stroke from the minimum to the maximum displacement is to be capable of being performed with this drive concept. Minimum strokes are realized for pure cutting operations, whereas maximum strokes, for example, are required when using transfer systems with corresponding degrees of freedom. In particular in the case of a ram having a large area, a plurality of drive points are necessary in order to avoid tilting of the ram. In this case, mechanical controlled synchronization is provided between the drive levers.

The motion characteristic of the proposed lever systems is characterized by a continually increasing transmission ratio in the direction of bottom dead center and thus by a correspondingly increasing press force.

In contrast to the conventional hydraulic press, a drive cylinder of substantially smaller diameter may therefore be selected; the number of strokes is markedly increased despite the lower drive power to be installed. The use of a so-called synchronous cylinder is especially advantageous for producing identical stroke or force ratios with the simplest closed-loop control. Since in each case the same diametral and thus area ratios are present in this cylinder in both stroke directions, there is also a very favorable control response.

Due to the smaller drive cylinder, the oil quantity required for operation is also reduced, as a result of which the undesirable compressibility of the pressure medium decreases. However, on account of the lever mechanisms connected in between, this compressibility is only of secondary importance, which has a favorable effect in particular for the reduction of the cutting impact occurring during cutting operations.

The motion and speed profile known from the mechanical presses also has an advantageous effect. In the cutting and forming region, the force increases on the one hand, but the speed is reduced. This speed, which continually decreases toward bottom dead center, is necessary in particular during the material flow during the forming operation in order to obtain good workpieces.

This advantageous kinematic sequence of motion is achieved by a considerably small number of components compared with a mechanical press. The press becomes more cost-effective and thus has corresponding efficiency with optimum sequences of motion from the forming point of view.

As already mentioned, any desired size of stroke can be performed with the proposed drive within the limits of the predetermined geometry. To this end, the drive cylinder may be provided with a displacement measuring system, which can be extended in combination with a displacement measuring system at the ram to form a position control loop. At the same time, it is also ensured in this application that the cylinder in each case travels only in one direction for a complete ram stroke, i.e. downward and upward movements. The ram stroke required in each case is then realized by the size of the associated stroke of the drive cylinder. Thus different ram strokes, e.g. for a drawing operation with subsequent sizing impact, are also possible in a forming process.

A controlled drive cylinder, by imposing a corresponding speed profile, permits any desired speed behavior of the ram. In addition to the forming process, this also offers considerable advantages during the use of automation equipment by optimizing the degrees of freedom.

A further embodiment according to the invention is shown by way of example by the drive of a plurality of rams through the use of additional coupling articulations. This arrangement is desirable, for example, in transfer presses which require a superimposed cutting ram for cutting die plates.

Further details and advantages of the invention follow from the description below of exemplary embodiments.

DETAILED DESCRIPTION OF THE PREFERRED EMBODIMENTS

Figure 1:
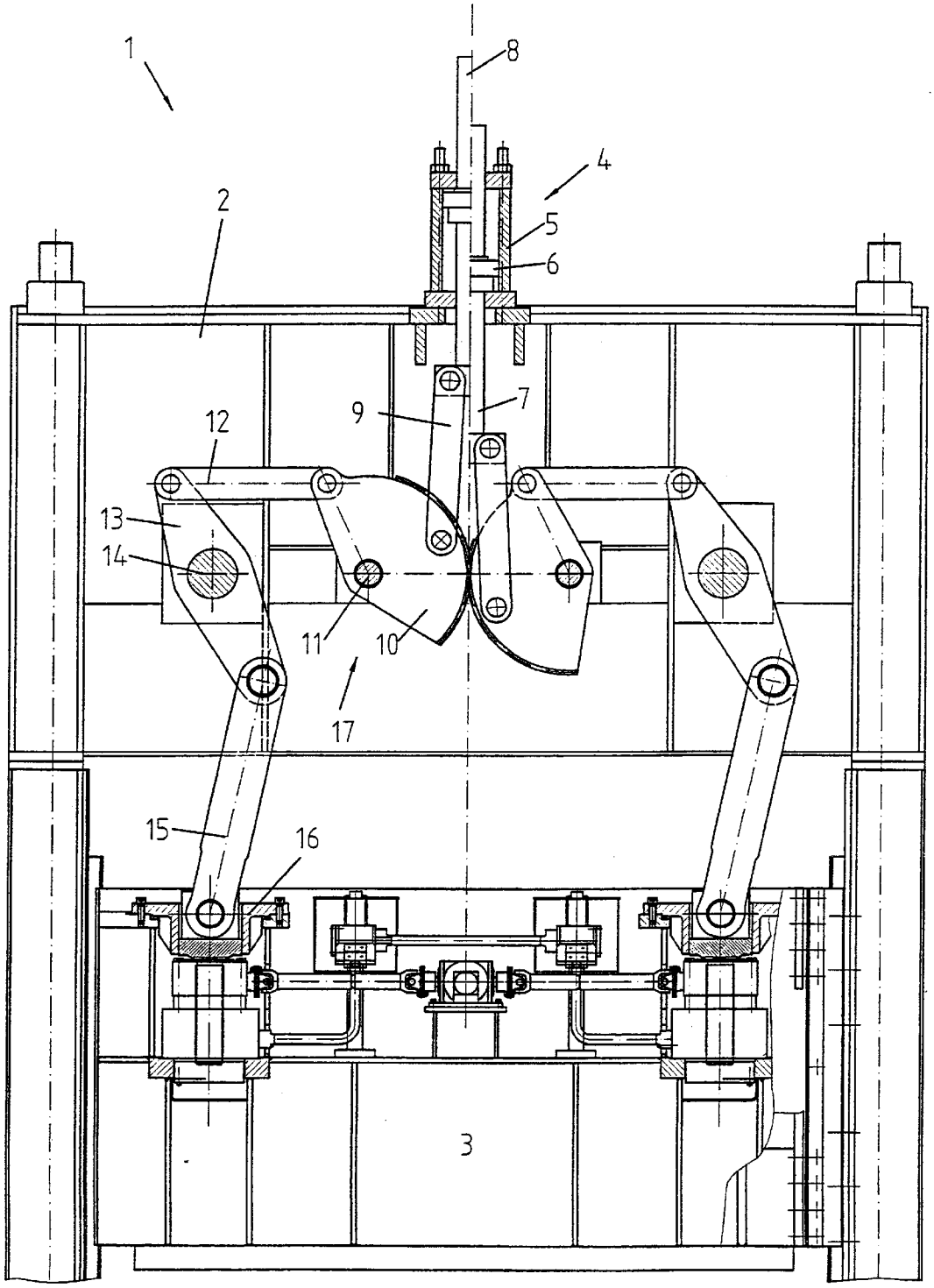
FIG. 1 shows a hydromechanical drive system with a drive cylinder, showing the start and the end of a maximum ram stroke.

FIG. 1 shows the top part of a press 1 having a column section 2 and ram 3. Drive cylinder 4, consisting of cylinder housing 5, piston 6 and piston rod 7, 8, is attached perpendicularly to column 2, Articulated lever 9 is fastened with one end to the piston rod 7 and with the other end to toothed segment 10. Toothed segment 10 can pivot in an arc of a circle about pivot 11. Coupling lever 12 is likewise fastenend with one end to the toothed segment 10, while the other end is connected to double lever 13. The pivot of double lever 13 is identified by 14. Furthermore, double lever 13 is connected to thrust lever 15, between which there is a connection to pressure point 16. This pressure point 16 known from mechanical presses may serve as overload protection to safeguard the press 1 and the tool and may also contain a device for adaptation to various tool heights.

The construction of the lever system shown in the left-hand press half is completely identical to the lever system on the right-hand side of the press. The representation in FIG. 1 shows two different positions of the articulated system 17. This representation has been selected in order to show that a complete ram stroke, i.e. downward and upward, is achieved with a cylinder stroke in only one direction, here downward. The left-hand side of the drawing shows the piston 6 of the drive cylinder 4 in the top position and the ram in the top dead center position. The right-hand half of the drawing shows the situation after the piston 6 has performed the downward stroke. The piston 6 is now in the bottom position, but the ram is again in the top dead center position. The change in position of the articulated system 17 can be seen from FIG. 1. The initial position for the next complete ram stroke is now with the piston 6 at the bottom.

As in the following examples too, the toothed segments 10 serve to synchronize the sequences of motion when using a plurality of ram pressure points.

Figure 2:
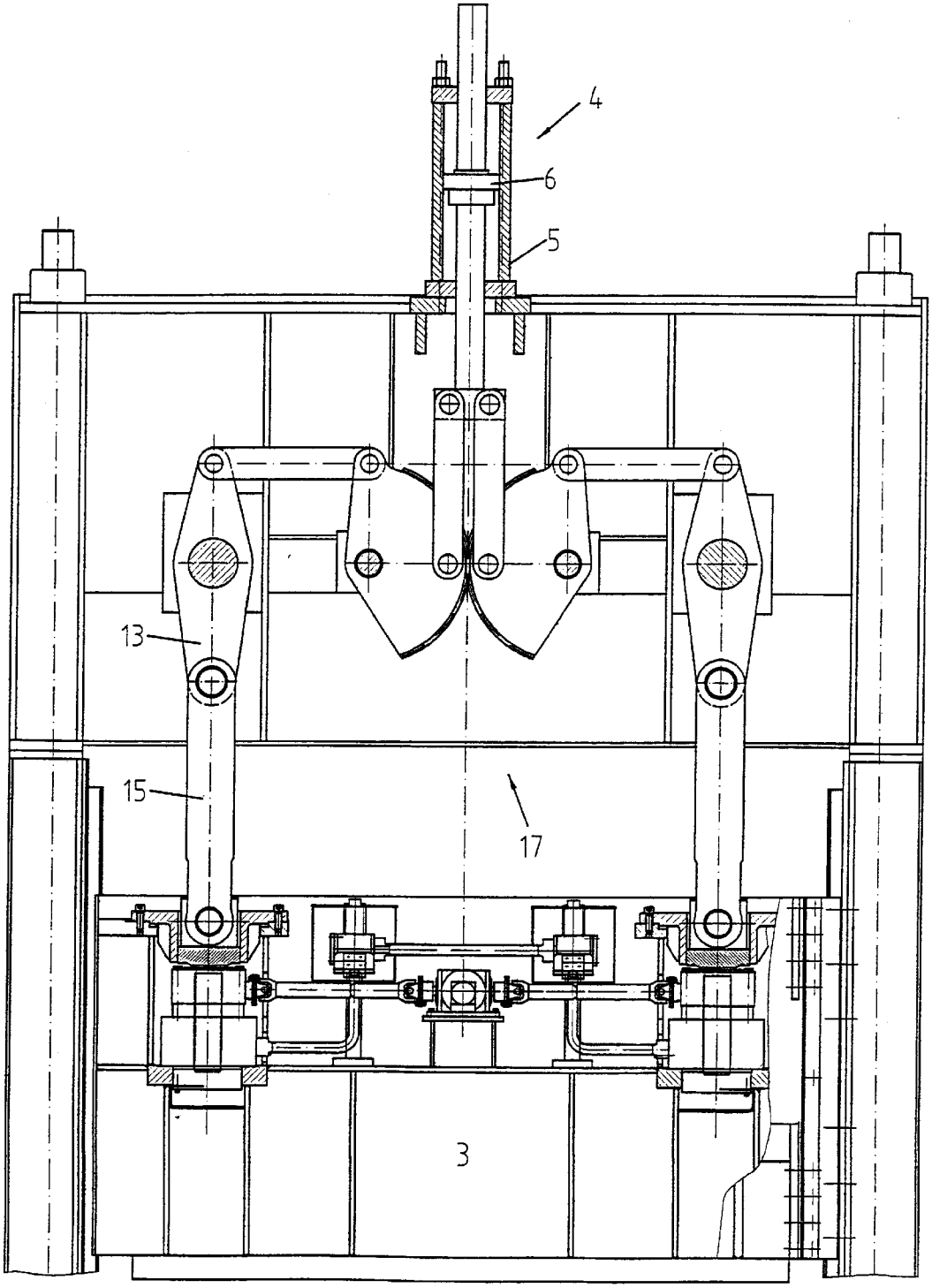
FIG. 2 shows the same as FIG. 1 but with the ram position at bottom dead center.

In FIG. 2, the ram 3 is shown at bottom dead center. Piston 6 is then located exactly in the center position of the cylinder housing 5. The desired effect of high forces at a low forming or cutting speed is achieved by the design of the articulated system 17. The effect of the transmission ratio accordingly consists in the fact that the ram speed is reduced when approaching the bottom dead center and the force increases in return. The extreme case is shown in FIG. 2, in which the speed is zero at a theoretically infinite magnitude of force. This is symbolized by the double lever 13 and thrust lever 15 located in an extended position relative to one another. The upward stroke of ram 3 is now initiated by further downward travel of piston 6.

Figure 3:
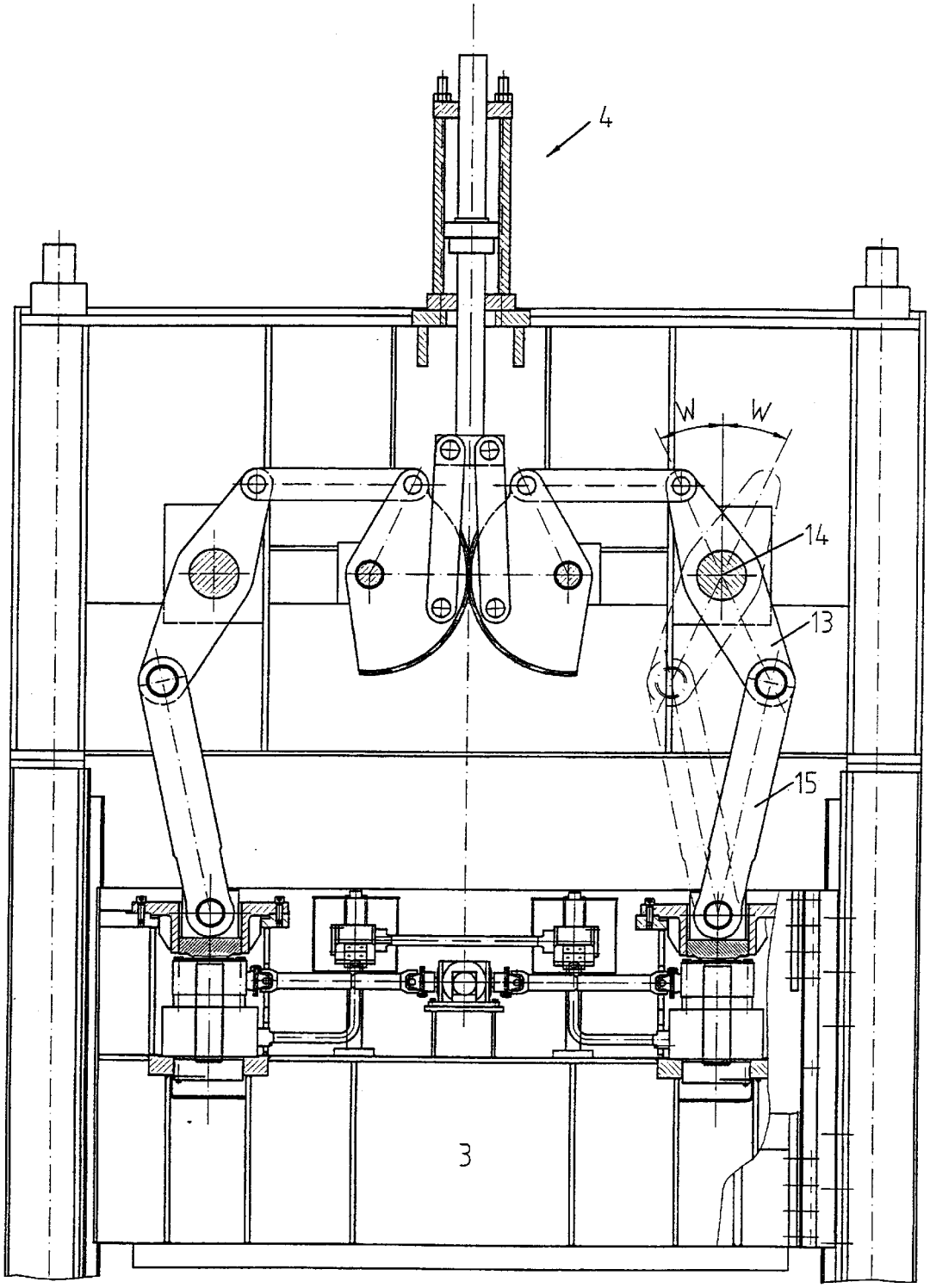
FIG. 3 shows the same as FIG. 1 but with a smaller ram stroke.

FIG. 3 shows a further possible sequence of motion. If a small ram stroke is required as the maximum stroke, e.g. for cutting or embossing work, this may be realized without problem by a corresponding smaller stroke of the drive cylinder. For this purpose, drive cylinder 4 is equipped with a displacement measuring system (not shown in any more detail). Due to the smaller drive stroke, the symmetrical pivoting angle W of the double lever 13 about the pivot 14 is also correspondingly smaller, which has a direct effect on the size of the ram stroke. This operation described permits an infinite variation of the ram stroke. Different ram strokes following one after the other during corresponding forming operations are likewise possible.

Figure 4:
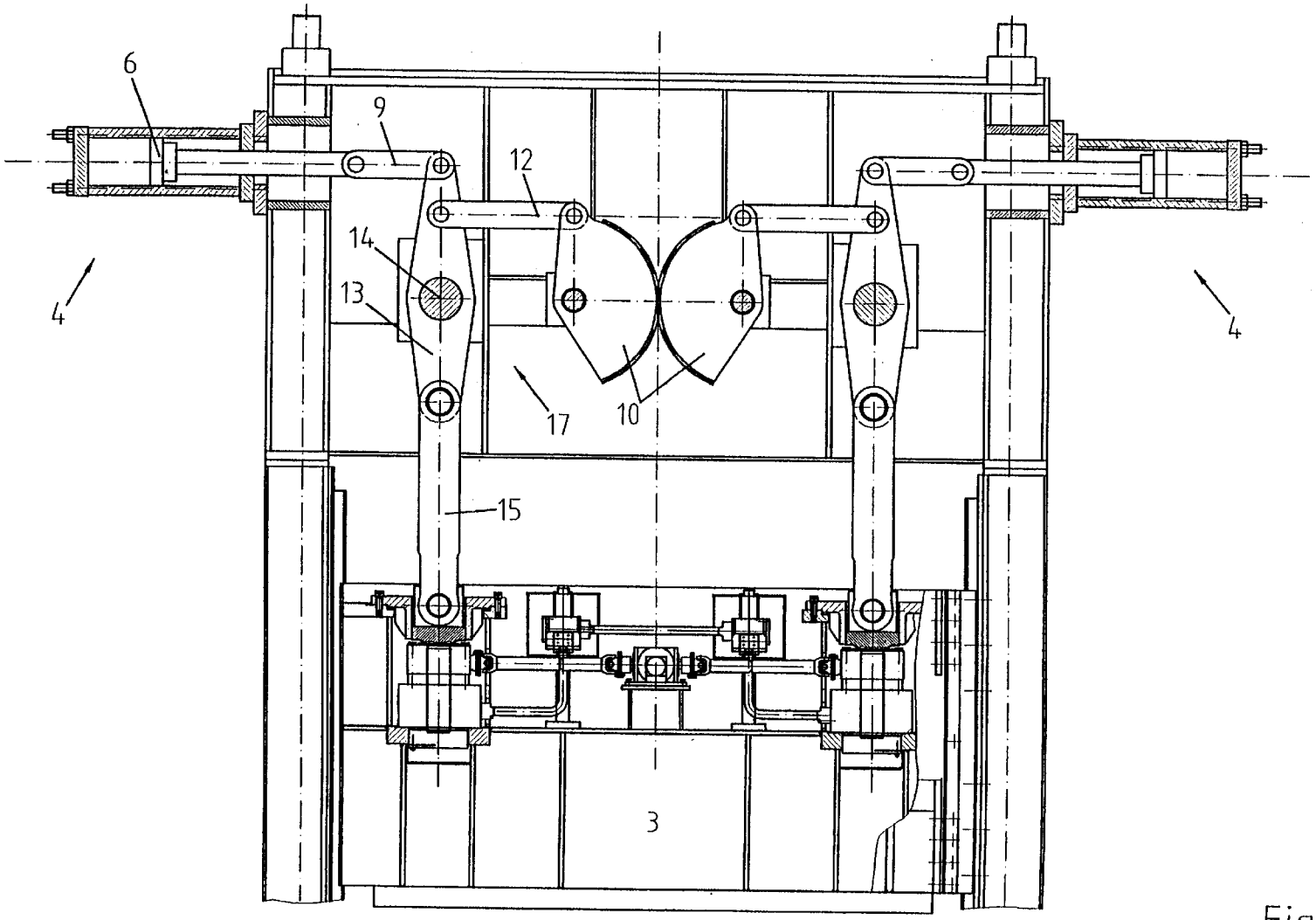
FIG. 4 shows a hydromechanical drive system with two drive cylinders and ram position at bottom dead center.

The importance of the synchronization function by means of the toothed segments 10 can be seen in particular when using two drive cylinders 4, as shown in FIG. 4. The fitting of two separate drive cylinders 4 may be necessary for constructional and functional reasons. The basic function of the articulated system 17 does not differ from the description of the preceding exemplary embodiments. The corresponding levers have been provided with the same item numbers as in the other exemplary embodiments. From the extended position of double lever 13 and thrust lever 15 and the position of piston 6, it can be seen that the ram 3 is located in the bottom dead center position.

Figure 5:
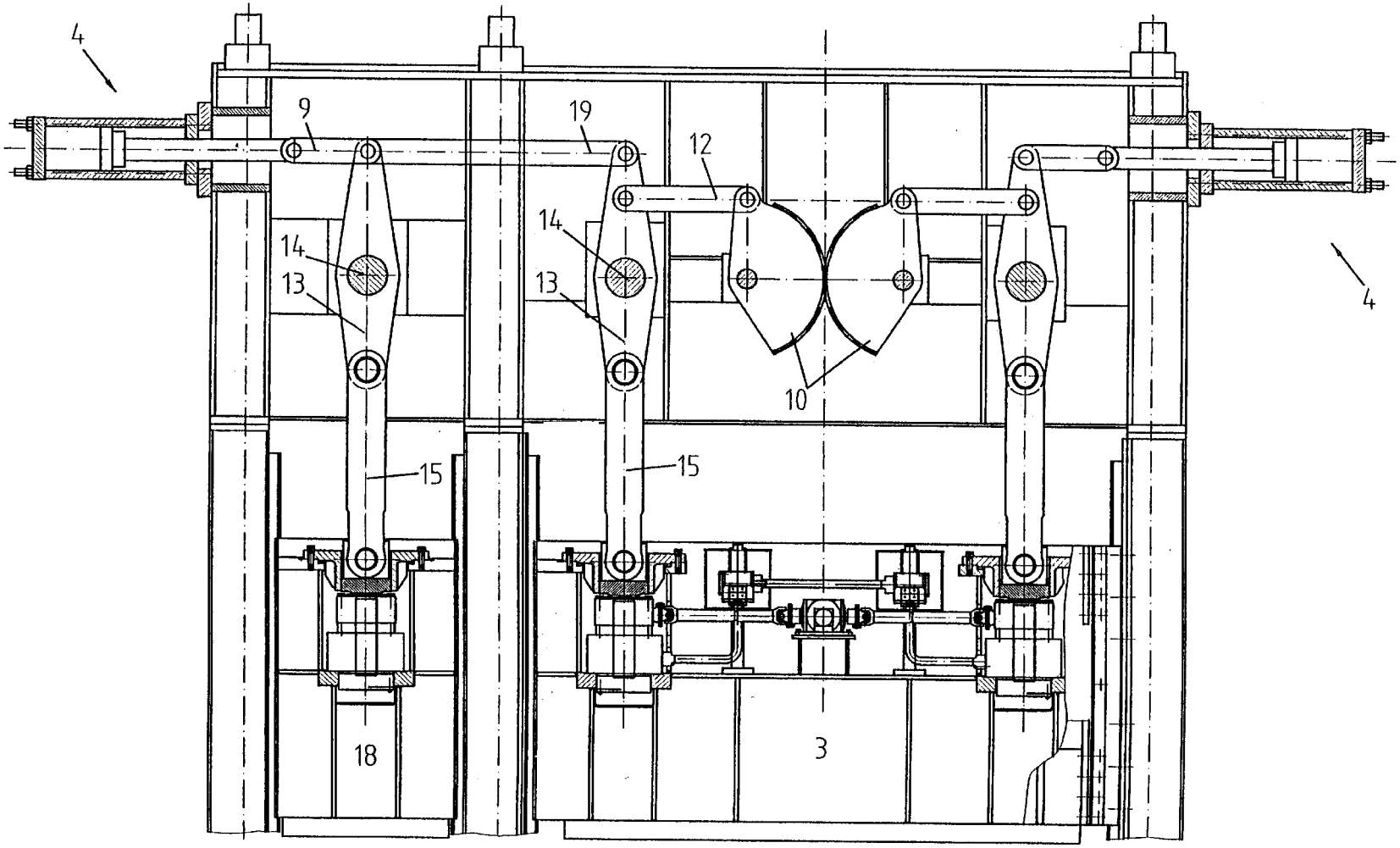
FIG. 5 shows a hydromechanical drive system for 2 rams.
Figure 6:
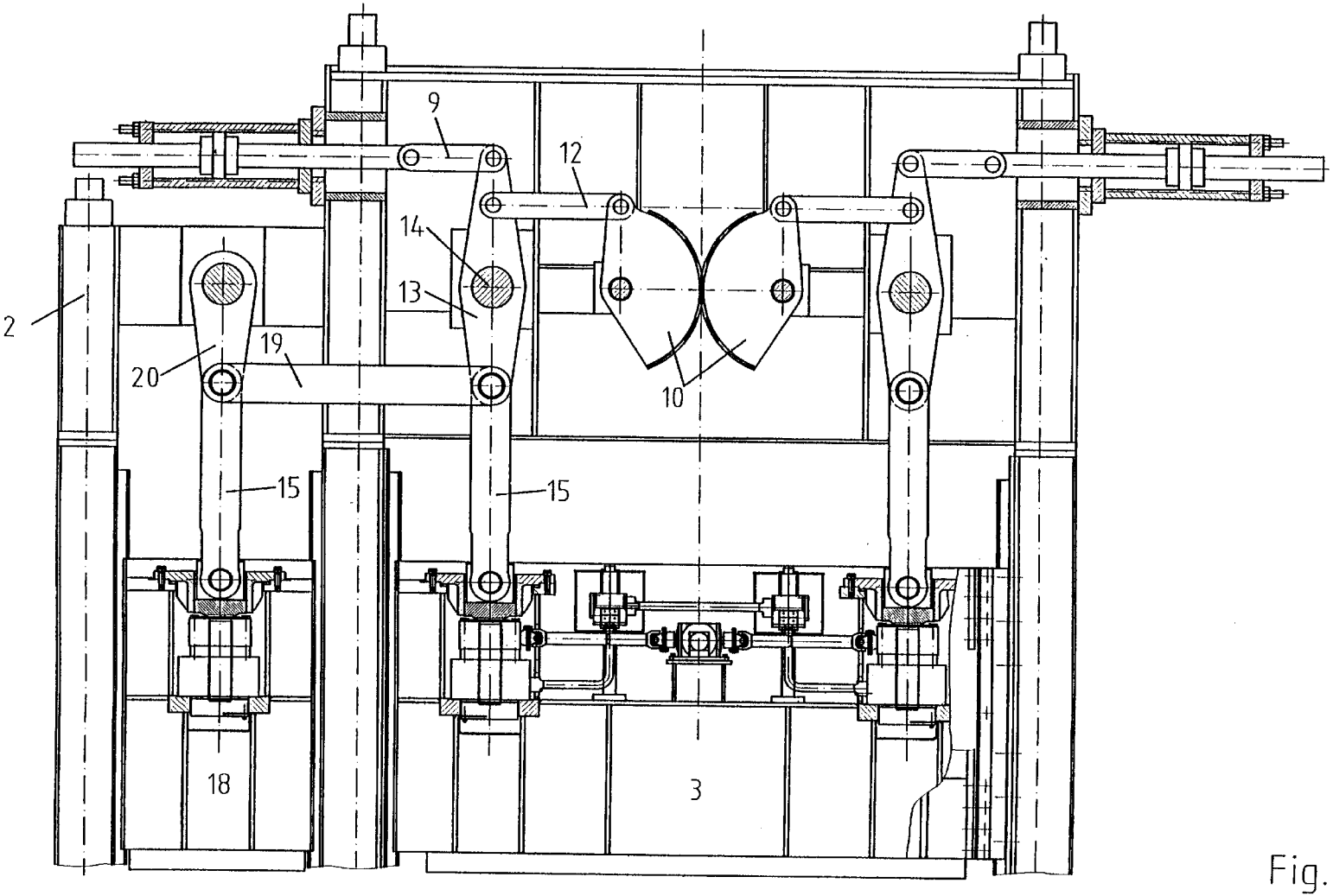
FIG. 6 shows an embodiment variant of FIG. 5

FIG. 5 shows the drive of a plurality of rams. Apart from the ram 3 for forming processes, the ram 18 is superimposed as a further ram, e.g. for cutting operations. This is therefore a press concept having 2 working rams 3, 18. It is important, then, that the drive system described can be extended with minimum outlay for driving further rams. In principle, the drive system need only be extended by a double lever 13, thrust lever 15 and coupling lever 19. Any different drive force which may be required can be provided by appropriately varied pressurizing of the drive cylinders 4. FIG. 6 shows a space-saving variant of FIG. 5. In addition to a simple design of press column 2, a single pivoted lever 20, instead of a double lever, may be used for the drive of the ram 18.

The invention is not restricted to the exemplary embodiment shown and described. It also comprises all developments by the person skilled in the art within the scope of the present invention.

What is claimed is:

1. A cutting and/or forming press comprising:

a drive cylinder;

a first press ram;

an articulated-lever system including a kinematic chain and a double lever connected to the kinematic chain;

the articulated-lever system being located between the drive cylinder and the first press ram, the drive cylinder having a piston rod;

wherein the piston rod of the drive cylinder is connected via the kinematic chain to the double lever, and the double lever is pivotable about a pivot and is connected via a thrust lever to the first press ram such that the first press ram moves through a complete ram stroke having a downward stroke and an upward stroke for each single stroke of the piston rod;

a second thrust lever;

a second press ram connected to and driven by the second thrust lever; and a second lever connected to each of the second thrust lever and the drive cylinder and driven by the drive cylinder.

2. The press according to claim 1, wherein, a ram stroke is varied by different piston strokes of the drive cylinder.

3. The press according to claim 1, wherein, the articulated-lever system further comprising toothed segments that synchronize the articulated-lever system in a controlled manner.

4. The press according to claim 3, wherein, the double lever is pivotable in a circular manner about the pivot to move through an angle W measured from both sides of a vertical axis passing through the pivot, the angle W depending on the stroke of the piston rod.

5. The press according to claim 4, wherein, the piston rod moves through a single stroke to move the double lever through an angular span equal to twice the angle W.

6. The press according to claim 5, wherein, the size of the stroke of the drive piston is detected and/or controlled via a displacement measuring system.

7. The press according to claim 6, the drive piston having a stroke speed, wherein, the stroke speed of the drive piston is controlled.

8. The press according to claim 1, wherein, the double lever is connected to the second lever via a coupling lever.

9. The press according to claim 1, wherein, a pressure point with overload protection and a forming-height adjusting device are arranged between the thrust lever and the first press ram.

10. A cutting and/or forming press comprising:

at least one drive cylinder;

a first press ram;

a second press ram;

an articulated-lever system including a kinematic chain and a plurality of double levers connected to the kinematic chain; and the at least one drive cylinder and the articulated-lever system being located between the drive cylinder and the first press ram, the at least one drive cylinder having a piston rod;

wherein the piston rod of the at least one drive cylinder is connected via the kinematic chain to the plurality of double levers, each of the plurality of double levers being pivotable about a respective pivot and at least one of the plurality of double levers is connected via a thrust lever to the first press ram such that the first press ram moves through a complete stroke having a downward stroke and an upward stroke for each single stroke of the piston rod, the double levers are connected to one another, and the second press ram is driven via a second thrust lever which is driven by the piston rod via another one of the plurality of double levers.

11. The press according to claim 8, wherein, the at least one drive cylinder is attached horizontally or vertically.

* * * * *